US005651454A

United States Patent [19]

Trimani

[11] Patent Number: 5,651,454

[45] Date of Patent: Jul. 29, 1997

[54] RIGID HINGED-LID PACKET FOR ELONGATED ITEMS, PARTICULARLY CIGARETTES

[75] Inventor: Carlo Trimani, Bologna, Italy

[73] Assignee: G.D Societa' per Azioni, Bologna, Italy

[21] Appl. No.: 541,637

[22] Filed: Oct. 10, 1995

[30] Foreign Application Priority Data

Oct. 13, 1994 [IT] Italy ..... BO94A0447

[51] Int. Cl.[6] ..... B65D 85/10; B65D 85/70; B65D 43/16

[52] U.S. Cl. ..... 206/273; 206/268; 206/443; 229/160.1

[58] Field of Search ..... 206/271, 273, 206/270, 268, 265, 443; 229/160.1

[56] References Cited

U.S. PATENT DOCUMENTS

| | | | |
|---|---|---|---|
| 3,874,581 | 4/1975 | Fox et al. | 206/268 |
| 4,267,958 | 5/1981 | Focke et al. | 229/160.1 X |
| 4,392,338 | 7/1983 | Fox | 206/268 X |
| 4,466,536 | 8/1984 | Zeitel | 206/273 |
| 4,729,508 | 3/1988 | Erdmann et al. | 229/160.1 X |
| 4,887,408 | 12/1989 | Mattei et al. . | |
| 5,024,376 | 6/1991 | Focke | 229/160.1 |
| 5,316,811 | 5/1994 | Focke et al. | 206/273 X |

FOREIGN PATENT DOCUMENTS

| | | |
|---|---|---|
| 0 082 388 | 6/1983 | European Pat. Off. . |
| 2 151 212 A | 7/1985 | United Kingdom . |

*Primary Examiner*—Bryon P. Gehman

*Attorney, Agent, or Firm*—Marshall, O'Toole, Gerstein, Murray & Borun

[57] ABSTRACT

A rigid hinged-lid packet for elongated items, particularly cigarettes; the packet being formed by folding a flat blank defined by a number of panels aligned with one another and each presenting two lateral wings; a first and second panel defining the front wall of a collar and the front wall of the container of the packet, and being connected to each other by an appendix foldable inside the second panel; a third and fourth panel defining the rear wall of the container and the rear wall of the lid of the container; each wing of the third panel and the corresponding wing of the fourth panel defining a recess engaged by the corresponding wing of the first panel; and each recess being so shaped and sized as to permit the passage of the corresponding wing of the first panel.

11 Claims, 4 Drawing Sheets

RIGID HINGED-LID PACKET FOR ELONGATED ITEMS, PARTICULARLY CIGARETTES

BACKGROUND OF THE INVENTION

The present invention relates to a rigid hinged-lid packet for elongated items, particularly cigarettes.

In the following description, specific reference is made to a rigid hinged-lid packet for cigarettes purely by way of example.

In the tobacco industry, packing machines are used for wrapping preformed groups of cigarettes inside respective foil wrappings, and conditioning the groups inside respective rigid packets, each comprising a cup-shaped hollow bottom container or body, and a cup-shaped top lid hinged to a top edge of the container so as to rotate between two positions respectively opening and closing the container.

Known rigid packets generally comprise a continuous rear wall divided into two parts by a virtual transverse hinge connecting the lid to the container; a front wall defined by two separate portions respectively constituting the front wall of the container and the front wall of the lid; and two lateral walls, each defined by a rear wing projecting laterally from the rear wall, and a front wing superimposed on the first and projecting laterally from the front wall. Like the front wall, each lateral wall is also defined by two separate portions respectively constituting the lateral wall of the container and the lateral wall of the lid.

Known rigid packets of the above type often present a U-shaped collar partly inserted inside the container, contacting the inner surface of the front wall and lateral walls of the container, and projecting upwards from the top edge of the container to partly engage the lid and prevent it from being accidentally opened when in the closed position.

On known packing machines, each rigid packet is formed by feeding the respective preformed group of cigarettes—already enclosed in the foil wrapping—through a loading station where it is combined with a respective U-shaped collar to form an assembly which, together with a respective blank, is fed to the input station of a wrapping wheel along which each blank is folded about the respective group of cigarettes to form a respective rigid hinged-lid packet.

Known packing machines therefore normally present two synchronized supply lines: one for the blanks, and the other for the collars.

To simplify the structure of known packing machines of the above type, and more specifically to eliminate the collar supply line, British Patent n. 2,151,212, for example, employs a blank wherein a free longitudinal end of an end panel, corresponding to the front wall of the container, is connected to the collar via the interposition of a longitudinal appendix; the collar comprises a central panel integral with the appendix, and two wings projecting laterally from the central panel; and the appendix of the blank is folded on to the inner surface of the end panel to define the front wall of the container complete with the collar.

Though it does in fact provide for eliminating the separate collar supply line, the above blank presents serious drawbacks due to the difficulty encountered on most known packing machines in folding the collar. On known packing machines, in fact, each blank, as it is fed forward on the wrapping wheel, is normally folded about the respective group in a succession of steps, the last one of which normally comprises folding the front wings on to the respective rear wings to complete the lateral walls of the packet.

In the case of a blank with a built-in collar as described in British Patent n. 2,151,212, the above final step would require radical alterations to known packing machines for producing rigid hinged-lid packets.

SUMMARY OF THE INVENTION

It is an object of the present invention to provide a rigid hinged-lid packet produced from a blank with a built-in collar, and which may be produced using known packing machines of the above type with no alterations required.

According to the present invention, there is provided a rigid hinged-lid packet for elongated items, particularly cigarettes, the packet comprising a cup-shaped container open at one end; a cup-shaped lid hinged to the rear edge of and for closing said open end; and a collar inserted inside the container and projecting outwards of the container through said open end; the packet being formed by folding a flat blank comprising a number of panels presenting respective pairs of longitudinal edges, and a longitudinal wing located outwards of each longitudinal edge of each panel; a first and second of said panels, presenting respective pairs of respective first and second said wings, defining the front wall of the collar and the front wall of the container; a longitudinal appendix connecting the first and second panels, and being folded inside the second panel so that the first panel partly contacts the inner surface of the second panel; and a third and fourth of said panels, presenting respective pairs of respective third and fourth said wings, respectively defining the rear wall of the container and the rear wall of the lid, and being connected to each other by a hinge connecting said lid to said container; the packet being characterized in that each third wing and the corresponding fourth wing define a recess engaged by the corresponding first wing; each said recess being so shaped and sized as to permit the passage of the corresponding first wing.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
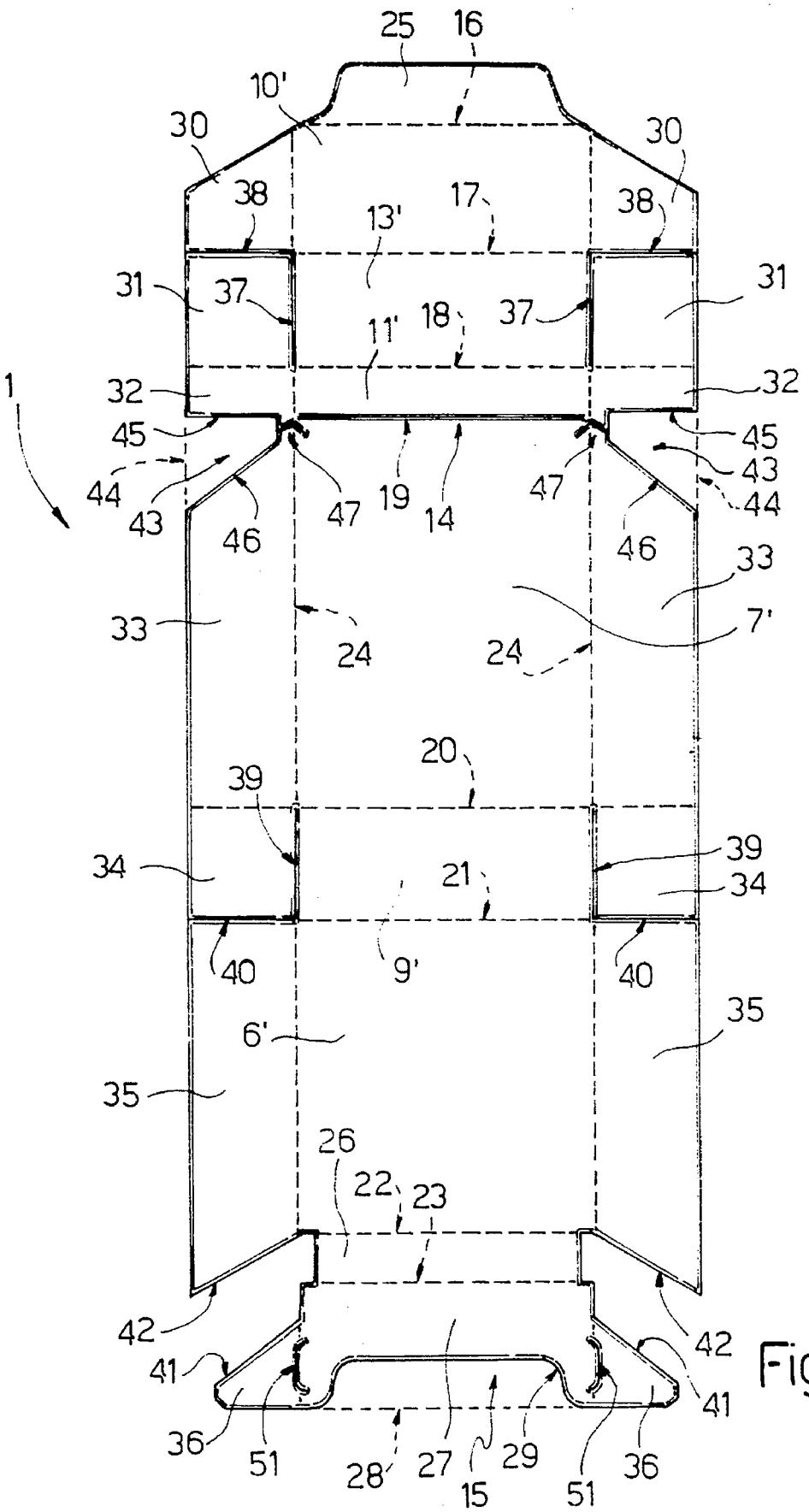
FIG. 1 shows a spreadout view of a first embodiment of a blank from which to form a packet in accordance with the present invention.

Number 1 in FIG. 1 indicates a flat, substantially rectangular blank from which to form a rigid packet 2 (FIG. 6) housing a group (not shown) of cigarettes enclosed in a foil wrapping (not shown), and comprising a cup-shaped bottom container 3 with an open top end 4, and a cup-shaped top lid 5 hinged to container 3 so as to rotate between two positions respectively closing and opening end 4.

Figure 6:
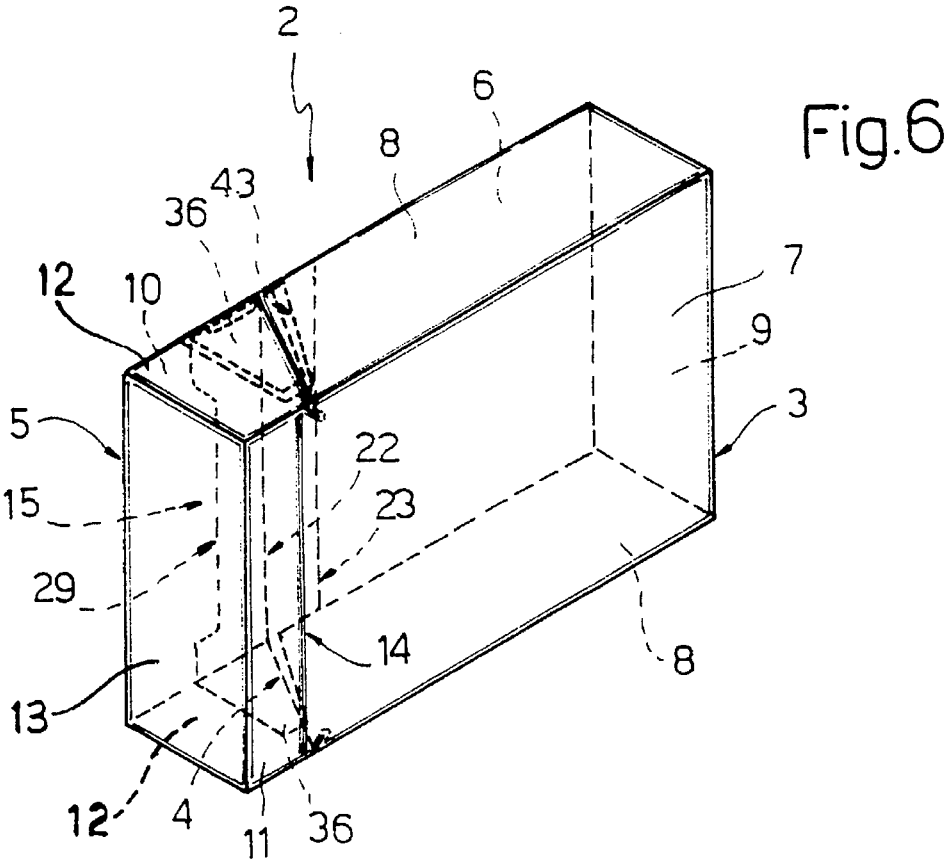
FIG. 6 shows a view in perspective of a packet in accordance with the present invention.

With reference to FIG. 6, container 3 presents a front wall 6 and a rear wall 7 facing and parallel to each other, two lateral walls 8 parallel to each other and perpendicular to walls 6 and 7, and a bottom wall 9 perpendicular to walls 6, 7 and 8; and lid 5 presents a front wall 10 and a rear wall 11 facing and parallel to each other, two lateral walls 12 parallel to each other and perpendicular to walls 10 and 11, and a top wall 13 perpendicular to walls 10, 11 and 12. More specifically, the free bottom edge of wall 11 is integral with the free top edge of wall 7 along a preformed bend line defining a hinge 14 about which lid 5 rotates between said open and closed positions.

As shown in FIG. 6, packet 2 also comprises a U-shaped collar 15 partly inserted through end 4 of container 3, and projecting outwards of container 3 to engage lid 5 and prevent it from being opened accidentally.

As shown in FIG. 1, blank 1 presents preformed longitudinal and transverse bend lines defining the walls and panels of packet 2.

For the sake of simplicity in the following description, the corresponding panels and walls of blank 1 and packet 2 will be indicated using the same reference numbers differentiated by a superscript for the panels and walls of blank 1.

As shown in FIG. 1, blank 1 presents a number of preformed transverse bend lines 16–23 and two preformed longitudinal bend lines 24 defining, on blank 1, a number of panels corresponding at least partly to the walls of container 3 and lid 5, and indicated, where possible, using the same reference numbers as the corresponding walls, plus a superscript.

Between lines 24, lines 16–23 define an end tab 25; an end panel 10' which is reinforced internally by tab 25 when this is folded 180° about line 16; a first intermediate panel 13'; a second intermediate panel 11' shorter in height than panel 13'; a first central panel 7' connected to panel 11' along line 19 defining hinge 14; and a second central panel 6' separated from panel 7' by a third intermediate panel 9'.

At the opposite end to that connected to panel 9', panel 6' presents a longitudinal appendix 26 extending from a central portion of line 22 and connected, along line 23, to an end panel 27 extending between lines 24 and defined, on the opposite side to line 23, by a straight edge 28 parallel to line 23 and presenting a central recess 29.

With reference to FIGS. 1, 2, 4 and 5, each line 24 defines tabs 30, 31, 32, 33, 34, 35 and 36 outwards of respective panels 10', 13', 11', 7', 9', 6' and 27, and each of tabs 31 outwards of panel 13' is detached from panel 13' and relative tab 30 by two cuts 37 and 38 extending respectively along lines 24 and 17, and is integral with relative tab 32 along line 18. Similarly, each tab 34 is integral with relative tab 33 along line 20, and is detached from panel 9' and relative tab 35 by two cuts 39 and 40 extending respectively along lines 24 and 21.

The length of each tab 36, measured crosswise to lines 24, is less than the width, measured in the same direction, of corresponding tabs 30–35, and each tab 36 is substantially in the form of a right angle trapezium or, more correctly, a right triangle with a rounded free vertex, the two catheti of which extend respectively along line 24 and edge 28, and the hypotenuse of which defines an oblique edge 41 facing a corresponding oblique end edge 42 of relative tab 35.

As opposed to being parallel, edges 41 and 42 diverge from relative line 24 to define a recess, the minimum width of which, measured along relative line 24, is less than twice the distance between lines 22 and 23, and the maximum width of which, measured at the end of tab 36, is substantially equal to twice the distance between lines 22 and 23.

In each pair of tabs 32 and 33, there is formed a recess 43 across line 19 and so shaped and sized as to permit the passage, in a direction perpendicular to the FIG. 1 plane, of tab 36 turned 180° about edge 28. More specifically, each recess 43 is substantially in the form of a right angle trapezium wherein the longer side coincides with the outer edge 44 of tabs 30–35 parallel to lines 24, the shorter side is adjacent to relative line 24, a first side 45, perpendicular to edge 44, is located on relative tab 32, and a second side 46, oblique and parallel to edge 41 of relative tab 36, is located on relative tab 33.

In addition to relative recess 43, each tab 32 is also separated from relative tab 33 by a cut 47 parallel to edge 42 and located between the relative end of hinge 14 and a mid point along the shorter side of recess 43.

Figure 2:
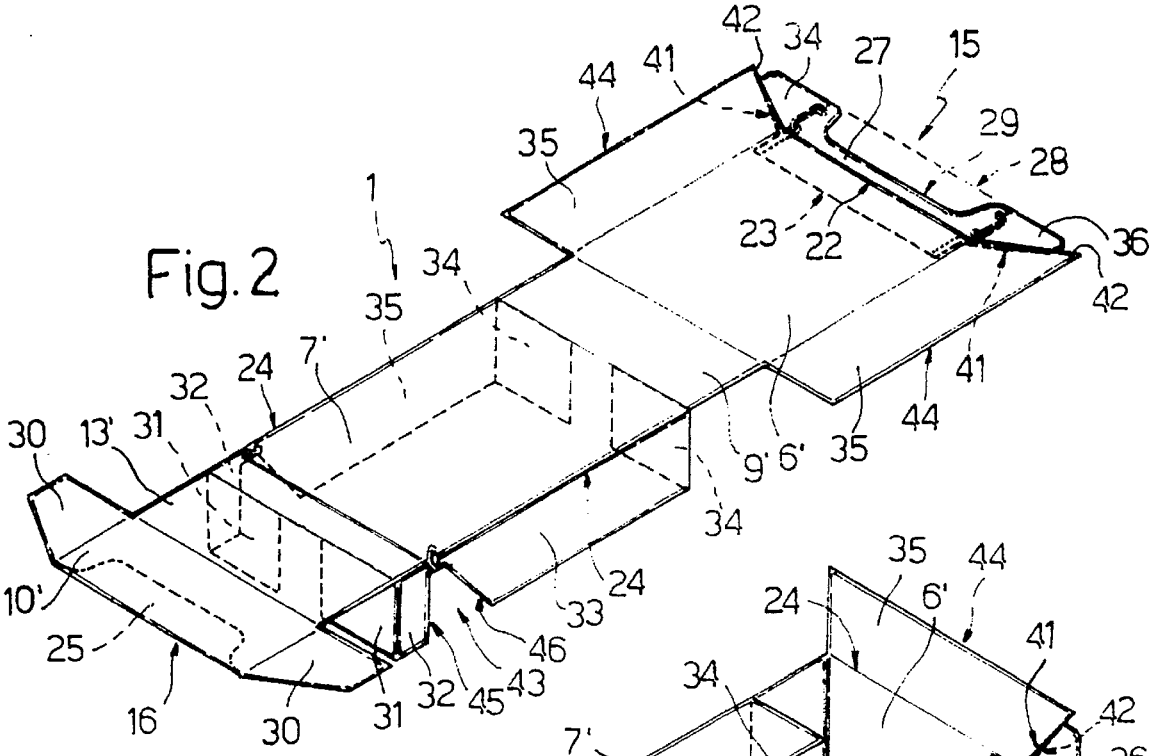
FIG. 2 shows a view in perspective of a first step in the folding of the FIG. 1 blank.

Blank 1 as described above is folded in a known sequence clearly deducible from FIGS. 2 to 5 and requiring no explanation. With reference to FIG. 2, however, it should be point out that, given the dimensions described of appendix 26 and the differing slopes of edges 41 and 42, when appendix 26 is folded inside panel 6', a relatively small, substantially triangular portion **36*a* of each tab 36 is positioned behind an end portion of relative tab 35 and may be gummed to tab 35**.

Figure 4:
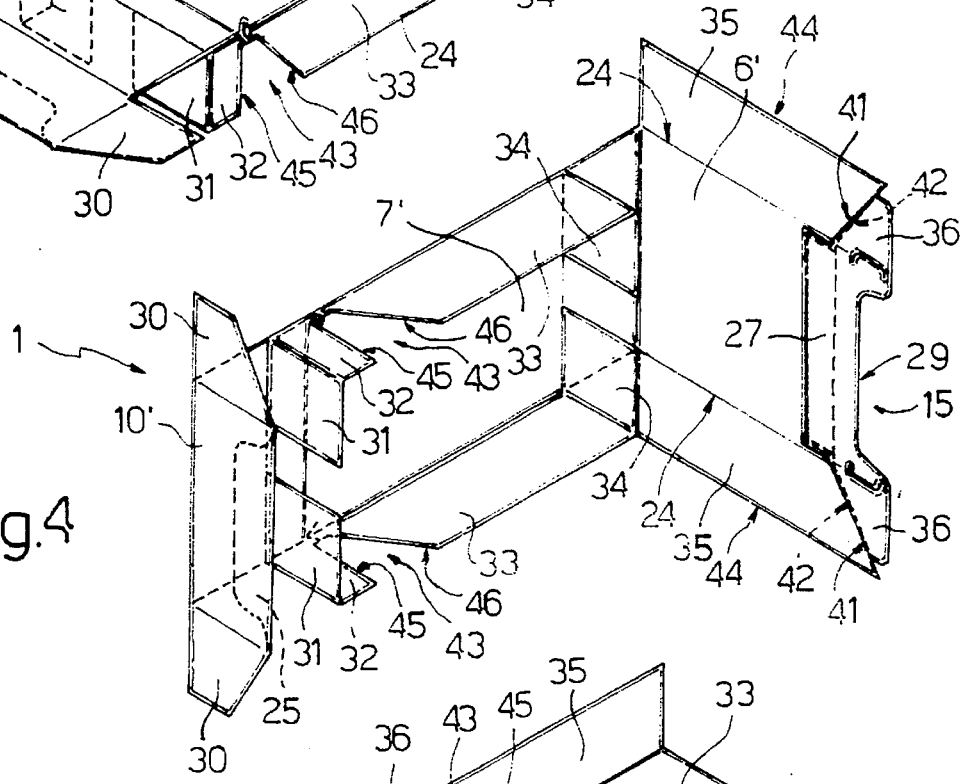
FIGS. 4 and 5 show respective views in perspective of a second and third step in the folding of the FIG. 1 blank.
Figure 5:
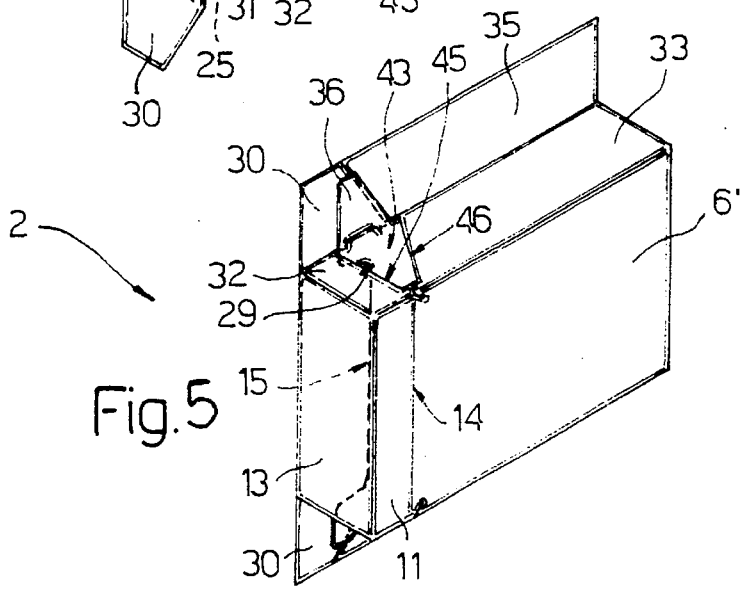
Figure 3:
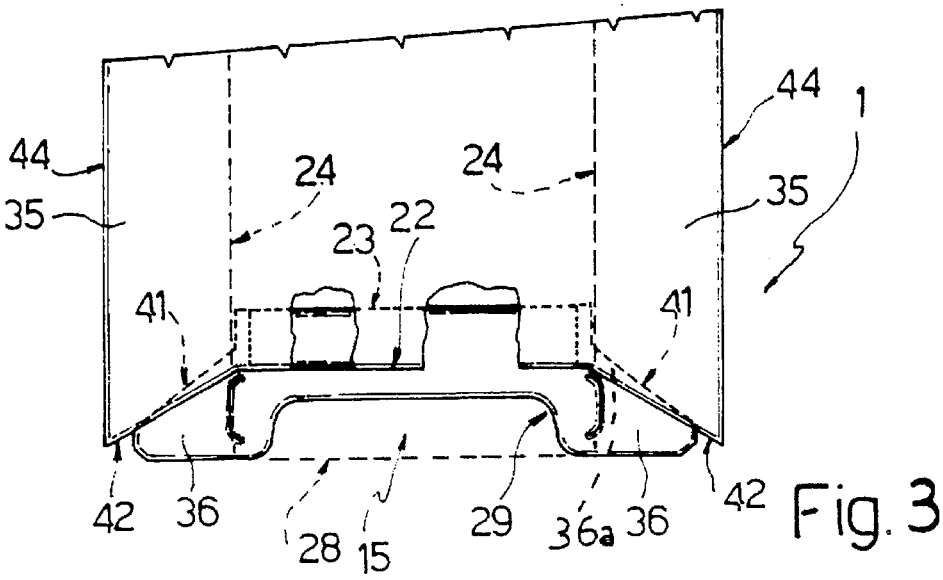
FIG. 3 shows a larger-scale plan view of a detail in FIG. 2.

A further point to note is that the steps in which blank 1 is folded to form packet 2 may differ from those shown in FIGS. 3 and 4, providing the final step in the folding of blank 1 is that shown in FIG. 5, i.e. wherein packet 2 is completed by folding tabs 30 and 35 squarely on to respective tabs 32 and 33.

Yet a further point to note is that, upon completion of the folding sequence, each cut 47 is superimposed on respective edge 42, and each tab 36 is located at and fits through relative recess 43 to directly contact a corresponding lateral wall (not shown) of the inner foil wrapping (not shown) to which tab 36 may be gummed integrally.

Blank 1 therefore provides, on the one hand, for using conventional wrapping wheels, and, on the other, for dispensing with the blank supply line, and so greatly simplifying the packing machines employed.

Moreover, by virtue of edge 28 of collar 15 being located, in packet 2, a given distance from wall 13 of lid 5, packet 2 may be used for packing groups (not shown) of cigarettes enclosed in a sealed wrapping (not shown) with a tear strip of the type described and illustrated in U.S. Pat. No. 4,887,408, thus enabling the formation of perfectly sealed, easy-to-open packets with no overwrapping of transparent material or similar. Finally, blank 1 may be modified as described in Italian Patent Application n. BO94A 000413 to tear-open connect lid 5 to container 3 or to collar 15.

Figure 7:
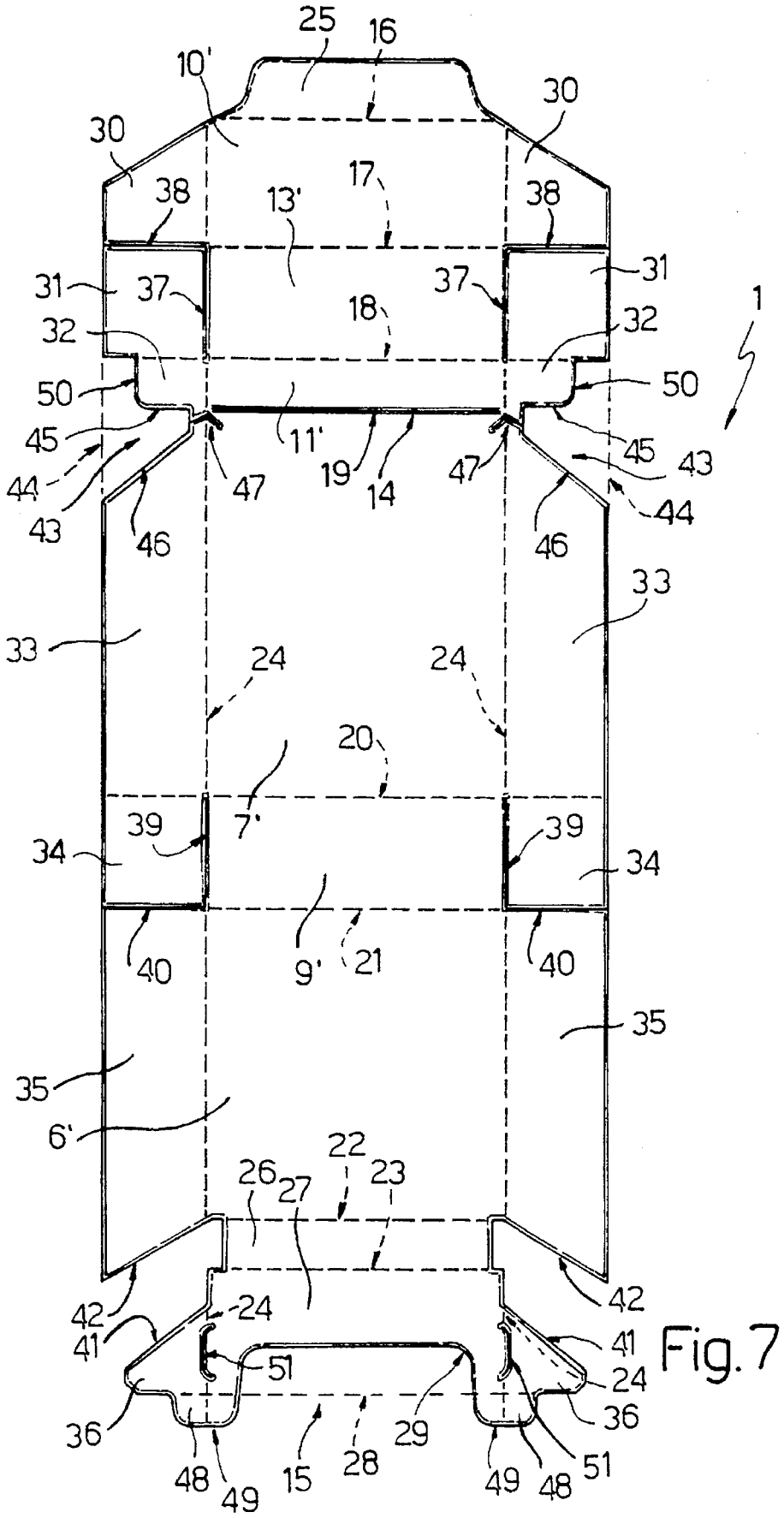
FIG. 7 shows a spreadout view of a variation of the FIG. 1 blank.

In the FIG. 7 variation, to better engage lid 5 in the closed position, the FIG. 1 collar 15 presents two additional appendixes 48, each extending from edge 28 parallel to and across respective line 24, and each defined by a free edge 49 parallel to edge 28 and which, inside packet 2, is located substantially contacting the inner surface of wall 13 of lid 5. Each appendix 48 imparts to each tab 36 a substantially L shape, and involves accordingly altering relative recess 43, which presents a lateral recess 50 formed by removing an end portion of tab 32 extending between edge 45 and line 18.

To improve the friction between lid 5 and collar 15, collar 15 in both the FIG. 1 and FIG. 7 versions presents two curved cuts 51 extending substantially along respective lines 24 and defining—in known manner, when tabs 36 are folded squarely in relation to panel 27—two tabs projecting outwards in relation to tabs 36.

I claim:

1. A rigid hinged-lid packet for elongated items, the packet comprising a cup-shaped container open at one end;

a cup-shaped lid hinged to the rear edge of and for closing said open end; and a collar inserted inside the container and projecting outwards of the container through said open end; the packet being formed by folding a flat blank comprising a number of panels presenting respective pairs of longitudinal edges, and a longitudinal wing located outwards of each longitudinal edge of each panel; a first and second of said panels, presenting respective pairs of respective first and second said wings, defining the front wall of the collar and the front wall of the container; a longitudinal appendix connecting the first and second panels, and being folded inside the second panel so that the first panel partly contacts the inner surface of the second panel; and a third and fourth of said panels, presenting respective pairs of respective third and fourth said wings, respectively defining the rear wall of the container and the rear wall of the lid, said respective pairs of respective third and fourth said wings being connected to each other by a hinge connecting said lid to said container; the packet being characterized in that each third wing and the corresponding fourth wing define a recess engaged by the corresponding first wing; each said recess being so shaped and sized as to permit the passage of the corresponding first wing.

2. A packet as claimed in claim 1, characterized in that each said recess and each said first wing are substantially in the form of a right angle trapezium.

3. A packet as claimed in claim 2, characterized in that each first wing presents a first and second edge extending respectively parallel to and perpendicularly to the relative said longitudinal edge; and a third oblique edge; the relative second wing presenting an oblique end edge (42) facing the corresponding third edge.

4. A packet as claimed in claim 3, characterized in that each said third edge and the relative said end edge of said blank diverge from the respective said longitudinal edge to define a recess, the minimum width of which, measured along said longitudinal edge, is less than twice the width of said appendix measured in the same direction, and the maximum width of which, measured in the same direction, is at least equal to said width of said appendix.

5. A packet as claimed in claim 4, characterized in that each said recess of said blank is substantially in the form of a right angle trapezium, wherein the longer side coincides with the outer edge of the relative said third and fourth wings and is parallel to the relative said longitudinal edge; the shorter side is located adjacent to said longitudinal edge; a first side, perpendicular to said outer edge, is located on the relative said fourth wing; and a second side is oblique, parallel to said third edge of the relative first wing, and located on the relative third wing.

6. A packet as claimed in claim 5, characterized in that, in addition to the relative said recess, each said fourth wing is also detached from the relative third wing by a cut parallel to the relative said end edge and located between the relative end of said hinge and an intermediate point along the shorter side of the relative recess.

7. A packet as claimed in claim 1, characterized in that the length of each first wing, measured crosswise to the relative said longitudinal edge, is less than the width of the corresponding other wings measured in the same direction.

8. A packet as claimed in claim 1, characterized in that, at said first panel end, said blank is defined by a straight end edge extending also along said first wings.

9. A packet as claimed in claim 8, characterized in that a fifth of said panels defines the front wall of said lid; said straight end edge projecting outwards of said second panel by a distance less than the height of said fifth panel.

10. A packet as claimed in claim 9, characterized in that said collar presents two longitudinal appendixes, each extending from said end edge and across a relative said longitudinal edge, and each defined by a free edge parallel to said end edge; said free edge projecting outwards of said second panel by a distance substantially equal to the height of said fifth panel.

11. A packet as claimed in claim 10, characterized in that each said longitudinal appendix imparts to the respective said first wing a substantially L shape; the corresponding said recess presenting a lateral recess formed by removing an end portion of the relative said fourth wing.

* * * * *